United States Patent [19]

Silva

[11] 4,308,878

[45] Jan. 5, 1982

[54] CURLING IRON HOLDER

[76] Inventor: Wilbur W. Silva, 704 Creek View Ct., Modesto, Calif. 95351

[21] Appl. No.: 98,704

[22] Filed: Nov. 29, 1979

[51] Int. Cl.[3] ..... A45D 2/24

[52] U.S. Cl. ..... 132/37 R; 219/242

[58] Field of Search ..... 132/37 R, 33, 9; 219/242; 174/46; 165/80 R

[56] References Cited

U.S. PATENT DOCUMENTS

| | | | |
|---|---|---|---|
| 1,424,546 | 8/1922 | Yeager | 219/242 |
| 1,528,493 | 3/1925 | Lamb | 174/46 |
| 1,530,352 | 3/1925 | Cook | 219/242 |
| 2,172,682 | 9/1939 | Rauba | 219/242 |
| 3,327,981 | 6/1967 | Yates | 219/242 |
| 4,103,145 | 7/1978 | Olivori | 219/242 |

FOREIGN PATENT DOCUMENTS

| | | | |
|---|---|---|---|
| 625992 | 2/1936 | Fed. Rep. of Germany | 174/46 |

*Primary Examiner*—G. E. McNeill

*Attorney, Agent, or Firm*—Thomas H. Olson

[57] ABSTRACT

A curling iron holder formed of molded plastic and defining a central cavity sized to receive the heated portion of a conventional curling iron. The diameter of the cavity is greater than that of the heated portion of the curling iron so that there is an annular space between the outer surface of the curling iron and the inner surface of the cavity. Extending into the cavity at longitudinally limited sites is a plurality of centering guides which hold the curling iron centrally of the cavity to maintain such annular space. There are openings at opposite ends of the annular space to afford air circulation therethrough. At one end of the cavity is an enlarged mouth which facilitates entry of the curling iron and which assures that the heated parts thereof are entirely surrounded by the holder. An external linear rib adjacent the mouth prevents the holder from rolling on a flat surface. On the external surface of the holder is a pair of cord cleats which afford compact storage of the curling iron cord.

4 Claims, 2 Drawing Figures

CURLING IRON HOLDER

BACKGROUND OF THE INVENTION

1. Field of the Invention

This invention relates to a curling iron holder and more particularly to a curling iron holder adapted to receive therein a hot curling iron and to promote rapid cooling thereof.

2. Description of the Prior Art

U.S. Pat. No. 1,833,281 discloses a curling iron holder in the form of a stand adapted to be supported on a table. Extending from the stand is a metal ring into which the curling iron can be placed. When the curling iron is supported in the ring the heated surface of the curling iron is exposed so that the hand or arm of a careless person could be burned by contacting the curling iron.

U.S. Pat. No. 1,786,065 discloses a soldering iron holder which defines a cavity into which a hot soldering iron can be placed.

An existing problem that is unsolved by the above noted patent disclosures and by any other devices known to exist is encountered by travelers in that the traveler must wait until the curling iron has cooled before it can be packed with clothing or like flammable articles. For travelers on an extremely tight schedule, this problem can result in a traveler carrying a suitcase in one hand and a hot curling iron in the other hand, an embarassing situation particularly in hotel lobbies and like places of public access.

SUMMARY OF THE INVENTION

The preferred embodiment of the invention which is described in more detail hereinafter includes a housing which defines an elongate cavity into which the hot curling iron rod can be inserted. In the interior of the housing is a plurality of radial protrusions or guides which engage an axially limited portion of the heated rod at a support site so as to space the remainder of the rod from the walls of the cavity. There are openings at both ends of the cavity so that air can circulate along the radial space between the heated curling iron rod and the wall of the cavity.

At one end of the cavity the housing defines an enlarged mouth which permits a portion of the handle to be inserted thereinto, thus avoiding contact between any heated parts of the curling iron and any clothing or other flammable articles with which it is packed. On the exterior of the housing are cord cleats around which the curling iron cord can be wrapped thereby providing compact storage of the cord as well as retaining the heated rod portion of the curling iron within the cavity.

An object of the invention is to provide a holder which totally surrounds the heated portion of a curling iron to avoid contact therewith by clothing or other flammable articles. This object is achieved by dimensioning the cavity and the mouth so that all heated portions of the curling iron can be received therein.

Another object is to provide a curling iron holder in which the likelihood of inadvertent dislodgement of the curling iron from the holder is reduced or eliminated. This object is achieved by providing cord cleats on the exterior of the housing which both retain the curling iron within the cavity and provide a compact storage location for the cord.

A further object is to provide a curling iron holder which promotes rapid cooling of the curling iron without risking exposure of the heated parts thereof to contact with flammable articles. This object is achieved by forming the cavity so that there is an annular space between the cavity wall and the curling iron and by venting such space at both ends to afford air circulation therethrough.

Yet another object of the invention is to provide a holder which can be economically mass produced. This object is achieved because a holder according to the invention can be molded in one piece from any suitable thermal resistant plastic.

The foregoing together with other objects, features and advantages will be more apparent after referring to the following specification and the accompanying drawings.

DESCRIPTION OF THE PREFERRED EMBODIMENT

Figure 1:
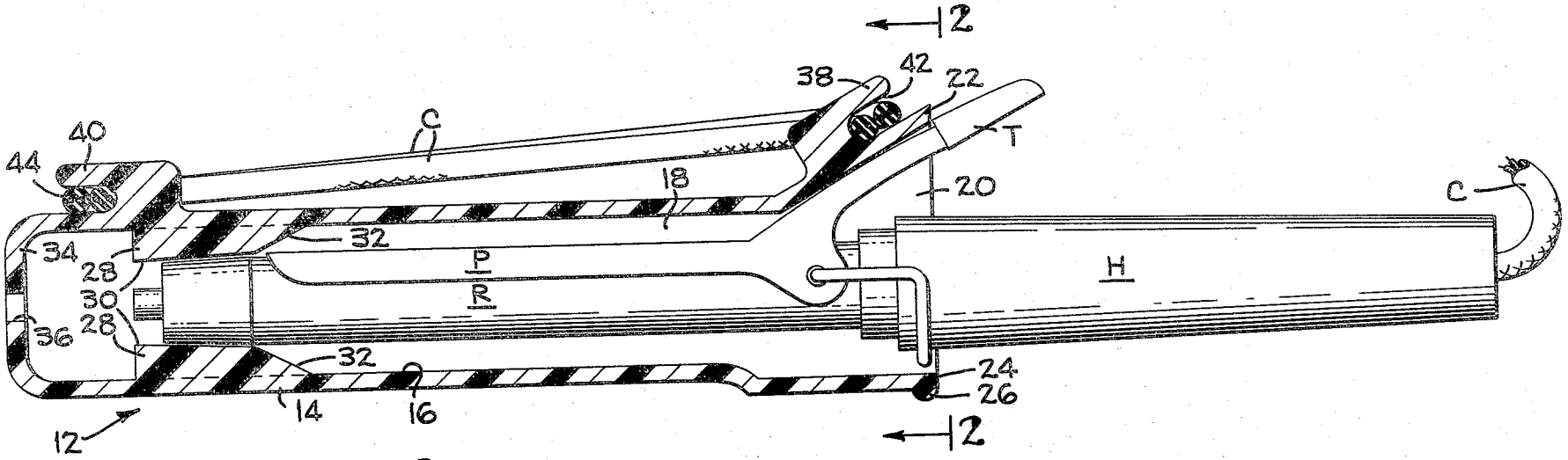
FIG. 1 is a view of a curling iron holder embodying the invention taken through a diametrical plane extending longitudinally of the body.

Referring more particularly to the drawings, reference numeral 12 generally indicates a curling iron holder constructed in accordance with the invention. The curling iron holder is preferably molded in one piece from a suitable synthetic plastic material such as styrene, ABS or the like which has low thermal conductivity and which is resistant to undue softening at elevated temperatures typically produced by a curling iron. Curling iron holder 12 is adapted to receive and hold a curling iron of the type shown in FIG. 1 which has a handle H, a metal rod R extending from the handle and containing a heating element, a power cord C for conducting electric current to the heating element, and a clamp piece P which is spring biased into contact with rod R and has a thumb lever T to afford outward pivotal movement of the clamp piece.

Figure 2:
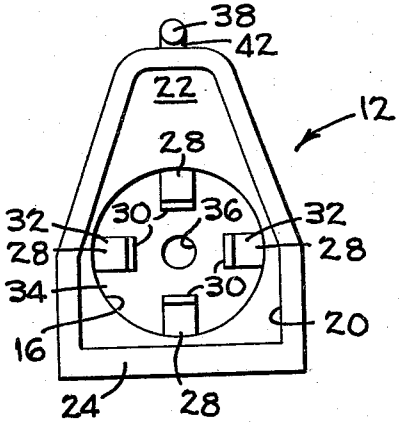
FIG. 2 is an end view taken along line 2—2 of FIG. 1, the curling iron being absent in FIG. 2.

Holder 12 has a main body 14 which has a cylindrical internal wall surface 16 that defines an elongate cylindrical cavity. As can be seen in FIG. 1, the cavity defined by wall surface 16 has a diameter sufficiently larger than the diameter of rod R that an annular space 18 is formed between the outer surface of rod R and cylindric cavity surface 16. The cavity at one end (the right-hand end as viewed in FIG. 1) extends to the exterior of one longitudinal end of housing 12 at which is defined an enlarged mouth 20. Mouth 20 affords insertion of rod R into the cavity formed by wall 16. In addition, mouth 20 has an enlarged portion defined by an outwardly diverging wall 22 so as to permit entry into the cavity of a part of the handle H and all metalic portions of the curling iron, such as thumb lever T. As can be seen most clearly in FIG. 2, mouth 20 includes at a location diametrically opposite wall 22 a flattened chordally extending portion 24 from which depends a linear rib 26 for bearing on a flat surface. The presence of linear rib 26 permits the holder to be placed on a table surface in a stable position.

Rigid with body 14 and projecting radially inward from surface 16 is a plurality of ribs or guides 28. It will be noted from FIG. 1 that guides 28 are spaced within the cavity remote from mouth 20. The inner surfaces 30 of guides 28 are oriented tangentially of the cavity formed by surface 16 and define a support site for the tip of rod R of the curling iron. As depicted in FIG. 1, surfaces 30 have a slight taper in a direction to diverge toward mouth 20. At the axial extremity of guides 28 proximate mouth 20, the guides are bevelled as at 32 so as to diverge outwardly toward mouth 20 and guide curling iron rod R into the support site and into a position where the rod is spaced from the cavity wall to afford air circulation. As can be seen most clearly in FIG. 2, guides 28 are circumferentially limited and are four in number. Accordingly, at the circumferential intervals between adjacent guides there is a passage to afford circulation of air.

At the end of body 14 remote from mouth 20 there is an integral end wall 34 centrally of which is formed an opening 36. As can be seen in the drawing, opening 36 is sufficiently large to afford air circulation through the space between the rod and the cavity wall surface 16 of housing 14, but is sufficiently small to exclude fingers, articles of clothing and like flammable material from contact with rod R. Moreover, wall 34 is axially spaced from the support site formed by guides 28 that the end of rod R is axially spaced inward from wall 34 and hole 36.

Integral with body 14 on the exterior surface thereof is a first cord supporting cleat 38. On the opposite end of the body is a second cord supporting cleat 40. As indicated in FIG. 1, cleats 38 and 40 define outward opening slots 42 and 44, respectively, which are sized to receive cord C therein. The cord can be wrapped back and forth between cleats 38 and 40 to afford compact and neat storage of the cord. Additionally, the engagement of the cord onto cleats 38 and 40 with a slight degree of tension serves to retain the curling iron within the cavity against inadvertent dislodgement.

In operation the curling iron is activated by plugging in cord C to a suitable electrical receptacle. The curling iron can be disposed in the holder until it is sufficiently heated for use and the presence of linear rib 26 adjacent mouth 20 assures that the holder and the iron will not roll on horizontal table surfaces or the like. Additionally, because rod R is enclosed, the likelihood of injury by inadvertent touching of the rod or of damage to clothing by inadvertently permitting the clothing to contact the heated rod is eliminated. When the curling iron is to be used, it is withdrawn from the holder and used in the normal manner. When such use has been completed, the curling iron is reinserted into the cavity, bevelled surfaces 32 on guides 28 facilitating positioning of rod R centrally of the cavity to assure air circulation therearound. When the cord C is unplugged, it can be wrapped around cleats 38 and 40, preferably with sufficient tension to retain the curling iron within the cavity. The curling iron thus encased by the holder can be immediately packed in luggage with clothing or like articles and without risk of ignition of the articles. Such is the case because the material of which the holder 12 is constructed has extremely low thermal conductivity, in consequence of which the temperature of the outer surface of the holder will not rise significantly. Additionally, the presence of opening 36 and the annular space between rod R and cavity wall surface 16 affords air circulation so that the curling iron will quickly and safely cool.

Thus it will be seen that the present invention provides a curling iron holder which is useful during use of the curling iron and when the curling iron is to be stored or packed after use. The foregoing advantages are provided in accordance with the invention by an inexpensive, relatively compact device with no moving parts. Although one embodiment of the invention has been shown and described, it will be obvious that other adaptations and modifications can be made without departing from the true spirit and scope of the invention.

What is claimed is:

1. A heat insulative holder for an electric curling iron that has a handle, an elongate rod extending from the handle and an electric heating element internally of the rod for heating the rod comprising a body formed of molded synthetic plastic material of low heat conductivity and resistant to softening at elevated temperature, said body having a length greater than the length of said rod and a wall surface defining an elongate axially extending cavity for receiving said rod therein, said cavity having a cross sectional shape substantially greater than that of said elongate rod, said cavity having a first end opening to an axial extremity of said body and defining a mouth for affording insertion of said rod into said cavity, a plurality of axially and circumferentially limited guides rigid with said wall surface and projecting radially into said cavity at a location remote from and axially inward of said mouth, said guides having respective radial inner surfaces that are disposed to center said rod in said cavity in spaced apart relation to said wall surface and form a support site so as to form a space around said elongate rod between said rod and said wall surface, said guide surfaces having bevelled portions at the axial portions thereof proximate said mouth which diverge radially outward toward said mouth for guiding said rod into said support site.

2. A holder according to claim 1 wherein said cavity includes a second end axially opposite said first end, said body defining an axially oriented opening communicating said cavity at the second end to the exterior of said body, said opening being axially spaced from said support site and having a cross sectional dimension less than said rod, said opening affording air circulation through said space around said elongate rod.

3. A holder according to claim 1 wherein said curling iron has an electrical cord for conducting current to said heating element and wherein said body has a first cleat projecting radially outward therefrom at the extremity adjacent said mouth and a second cleat projecting radially outward therefrom at the extremity opposite said mouth, said cleats each defining axially extending slots.

4. A holder according to claim 3 wherein said mouth is formed at one circumferential portion with an outwardly diverging wall to afford partial insertion of the handle into said mouth, said mouth also having chordally extending external portion diametrically opposite said diverging wall and a linear rib on the exterior of said chordally extending portion for bearing on a flat surface, said cordally extending portion forming a boundary of said mouth.

* * * * *